US009603449B1

(12) United States Patent
Evans

(10) Patent No.: US 9,603,449 B1
(45) Date of Patent: Mar. 28, 2017

(54) UNIVERSALLY ADJUSTABLE RACK

(71) Applicant: Russell L Evans, Conway, AR (US)

(72) Inventor: Russell L Evans, Conway, AR (US)

( * ) Notice: Subject to any disclaimer, the term of this patent is extended or adjusted under 35 U.S.C. 154(b) by 0 days.

(21) Appl. No.: 15/098,561

(22) Filed: Apr. 14, 2016

(51) Int. Cl.
*A47B 81/00* (2006.01)
*A47B 45/00* (2006.01)

(52) U.S. Cl.
CPC ..... *A47B 81/005* (2013.01); *A47B 45/00* (2013.01)

(58) Field of Classification Search
CPC ..... A47F 5/0892; A47F 5/08; A47F 5/0838; A47F 5/0087; A01K 97/08; A01K 97/10; A47B 81/00; A47B 81/005; A47B 45/00; A47B 46/00; B60R 7/14
USPC ..... 211/116, 70.6, 70.8, 95, 113, 60.1, 115, 211/64, 75, 85.7, 87.01, 86.01, 94.01, 211/118; 206/315.11; 224/922, 913, 551; 43/21.2, 26; 248/205.1, 324, 349.1
See application file for complete search history.

(56) References Cited

U.S. PATENT DOCUMENTS 4,027,798 A 6/1977 Swaim
4,205,816 A * 6/1980 Yu ..... E06B 9/262 160/250
4,961,505 A 10/1990 Moeller
5,056,458 A * 10/1991 Askeland ..... B05B 15/0481 118/501
5,078,309 A * 1/1992 Hull ..... B60R 7/14 211/64
5,107,996 A * 4/1992 Whittaker ..... A47G 25/1457 211/113
5,524,772 A * 6/1996 Simmons ..... A47B 81/005 211/4
5,979,102 A 11/1999 Sagryn
6,155,440 A * 12/2000 Arce ..... A47F 5/0892 211/118
6,276,539 B1 8/2001 Richbourg
(Continued)

OTHER PUBLICATIONS

Organized Fishing 9-Capacity Wire/Horizontal/Ceiling Rod Rack http://www.walmart.com/ip/23662833.
(Continued)

*Primary Examiner* — Daniel J Troy
*Assistant Examiner* — Hiwot Tefera
(74) *Attorney, Agent, or Firm* — Joe D. Calhoun

(57) ABSTRACT

A rack system capable of attaching diagonally to both a vertical support (such as a wall) and to a horizontal support (such as a ceiling) or appendage thereof (such as a guide-track of an overhead-movable door), said rack system comprising one or more rigid racks including a pair of elongate members in slidable longitudinal alignment and with periodic holes that align at a desired aggregate length to accept pegs or other stop members that both prevent further length adjustment and provide a support for items to be held on the rack. One elongate rack member includes a lowermost end having a hinge-like adaptation facilitating attachment to the vertical support regardless of the diagonal angulation of the rack. The other elongate rack member includes an uppermost end having a hinge-like adaptation facilitating attachment to the horizontal support regardless of said diagonal angulation of the rack; this hinge-like adaptation may also include a clamp, for attachment to the guidetrack of an overhead-movable door such as a garage door.

15 Claims, 9 Drawing Sheets

(56) References Cited

U.S. PATENT DOCUMENTS

| | | | | |
|---|---|---|---|---|
| 6,708,940 | B2 * | 3/2004 | Ligertwood | F16M 11/10 248/279.1 |
| 6,725,608 | B1 | 4/2004 | Kraus | |
| 6,742,687 | B2 * | 6/2004 | Morford | B60R 7/14 211/64 |
| 6,910,592 | B1 | 6/2005 | Lindenmeyer | |
| 7,000,783 | B2 | 2/2006 | Webb | |
| 7,931,244 | B1 * | 4/2011 | Sipe | E03C 1/021 211/60.1 |
| 8,516,973 | B1 * | 8/2013 | Hamilton | B63H 20/06 114/347 |
| 8,636,155 | B2 | 1/2014 | Kern | |
| 2009/0101613 | A1 * | 4/2009 | Botkin | A47F 5/0892 211/115 |
| 2009/0242500 | A1 * | 10/2009 | Li | A47G 25/0685 211/116 |
| 2011/0198461 | A1 * | 8/2011 | Truckor | F16M 11/30 248/205.1 |

OTHER PUBLICATIONS

Garage door overhead rod storage—The Hull Truth—Boating and Fishing Forum http://www.thehulltruth.com/boating-forum/372465-garage-door-overhead-rod-storage.html#b.

* cited by examiner

UNIVERSALLY ADJUSTABLE RACK

CROSS REFERENCE TO RELATED APPLICATIONS

Not applicable.

FEDERALLY SPONSORED RESEARCH AND DEVELOPMENT

Not applicable.

MICROFICHE APPENDIX

Not applicable.

BACKGROUND OF THE INVENTION (1) Field of the Invention

The present disclosure relates to racks for holding or storing items, preferably (in some embodiments) elongate items such as fishing rods, paddles, brooms, implements and the like. More particularly, the invention disclosed herein relates to racks that may be mounted to a structure or other substratum in a variety of angles and/or lengths, preferably mounted diagonally to a horizontal support structure (such as a ceiling or guidetracks of an overhead-movable door) and a vertical support structure (such as a wall).

(2) Background of Invention

Some known racks that are arguably material to patentability include the following:

U.S. Pat. No. 6,276,539 issued to Richbourg is for a garage door mounted rod and reel holder. It discloses a holder or rack for storing a number of fishing rods and reels, using the inside of a garage door for support. Each of the brackets has at least three predrilled holes, and the mounting means comprises screws which are threaded through said holes and into the garage door panel. The brackets are mounted onto the back of a garage door, thereby utilizing the otherwise unused space on the flat panels of a garage door.

U.S. Pat. No. 6,910,592 issued to Lindenmeyer is for a fishing rod storage device comprising two mounting racks that are configured to allow one or more fishing rods to be placed in it stationary locations include, but are not limited to, a garage, boathouse, attic, or shed.

U.S. Pat. No. 7,000,783 issued to Webb is for a utility hook for attachment to an overhead garage door track, such that the upper portion of the utility hook may fit tightly against the outer vertical surface and outer horizontal upper flange of the ceiling mounted section of the garage door track. Also disclosed is a right angle extension comprising a lip formed in a manner as to engage and hold the garage door utility hook onto the ceiling mounted garage door track. There is also a long straight leg that is secured to a beam, and a short leg is adapted to hook over the garage door track.

U.S. Pat. No. 8,636,155 issued to Kern is for a pivotally mounted storage apparatus. Disclosed is a support rod pivotally movable between a storage configuration (at which the support rod is generally parallel to a beam) and an extended configuration at which the support rod is generally perpendicular to the beam; a capture member is displaced from the mounting member and configured to be attached to the beam inside the storage structure.

The website found at http://www.walmart.com/ip/23662833 discloses an organized fishing rod rack having a 9-capacity wire horizontal/ceiling rod rack" for mounting on the wall or on the ceiling.

Another website found at http://www.thehulltruth.com/boating-forum/372465-garage-door-overhead-rod-storage.html#b discloses a garage door overhead rod storage rack that is ceiling-mountable.

BRIEF SUMMARY OF THE INVENTION

In general, the invention disclosed herein includes (comprises) a rack capable of attaching diagonally to both a vertical support (such as a wall) and to a horizontal support (such as a ceiling) or appendage thereof (such as a guide-track of an overhead-movable door), said rack comprising a rigid rack member having a first end comprising a means of pivotal attachment to the horizontal support and having a second end comprising a means of pivotal attachment to the vertical support, said rack further comprising a plurality of support members for supporting at least one item to be supported by said rack.

A principal object of the current disclosure is to provide a rack having an adjustable length, and capable of diagonal attachment at various angles.

Another object of the current disclosure is to provide a rack that is light weight and adjustable.

Yet another object of the current disclosure is to provide a rack that can be mounted in the upper corner of a garage or other storage facility, to utilize little used space.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages herein provided will become apparent to one with skill in the art upon examination of the accompanying Figures and detailed description. It is intended that all such additional systems, methods, features and advantages that are included within this description, be within the scope of any claims filed now or later.

BRIEF DESCRIPTION OF FIGURES OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings.

DETAILED DESCRIPTION OF THE INVENTION

The terminology used herein is for the purpose of describing particular embodiments only, and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa It will be understood that, although the terms first, second, third, etc. may be used herein to describe various elements, these elements should not be limited by these terms. These terms are only used to distinguish one element from another element.

The disclosure herein is not limited by construction material(s) to the extent that such materials satisfy the structural and/or functional requirements. For example, any material may be used so long as it satisfies the rigid structural and supportive functional requirements for which it is being used.

Reference now should be made to the drawings, in which the same reference numbers are used throughout the different figures to designate the same components.

Figure 1:
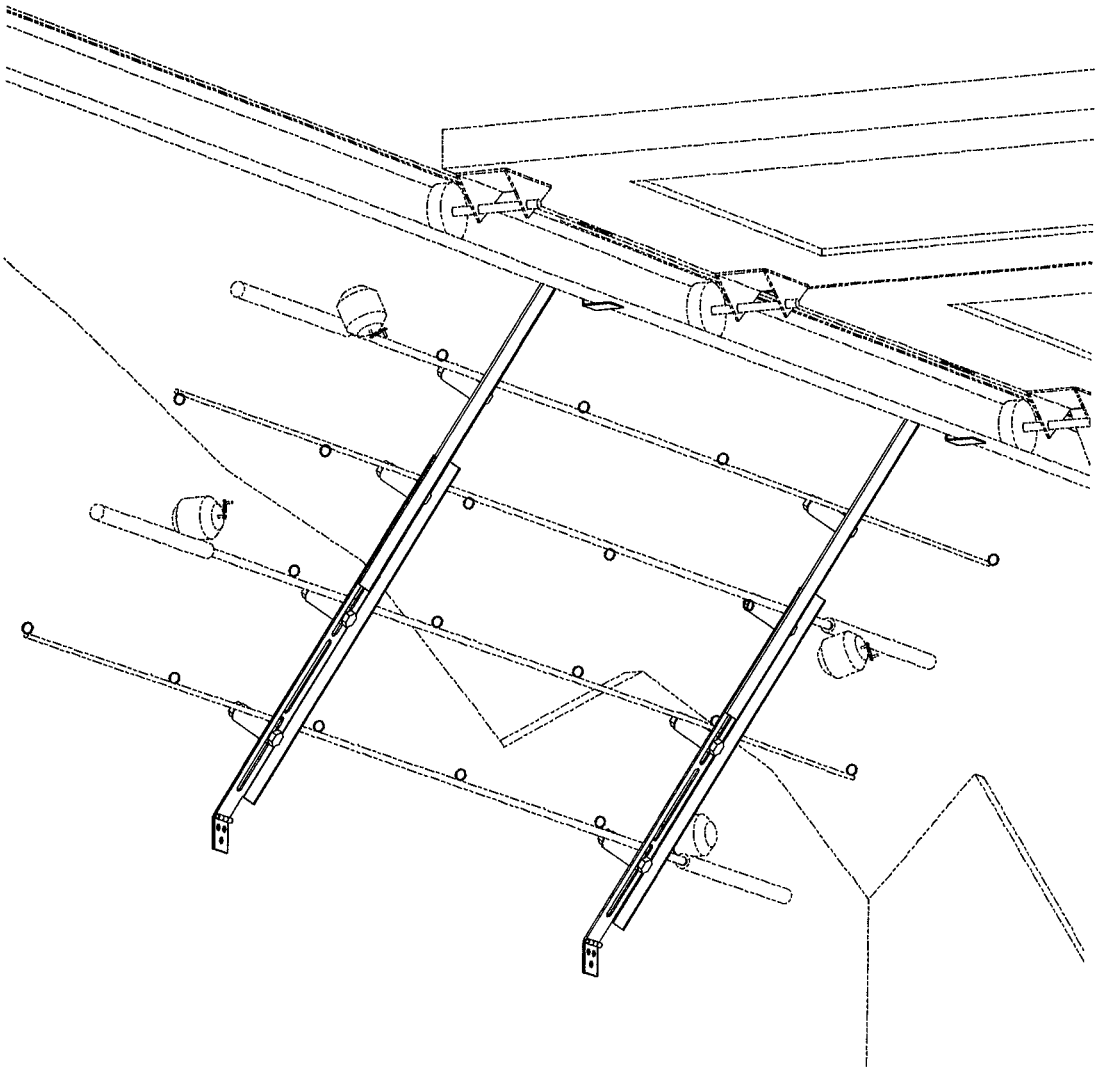
FIG. 1 depicts a perspective view of a representative sample of the rack, having one end mounted to the rail of an automatic garage door and the other end mounted to a wall of the garage.

FIG. 1 depicts a representative sample of a rack system, clamped to the guide track of an overhead-movable garage door and anchored to a wall.

Figure 2:
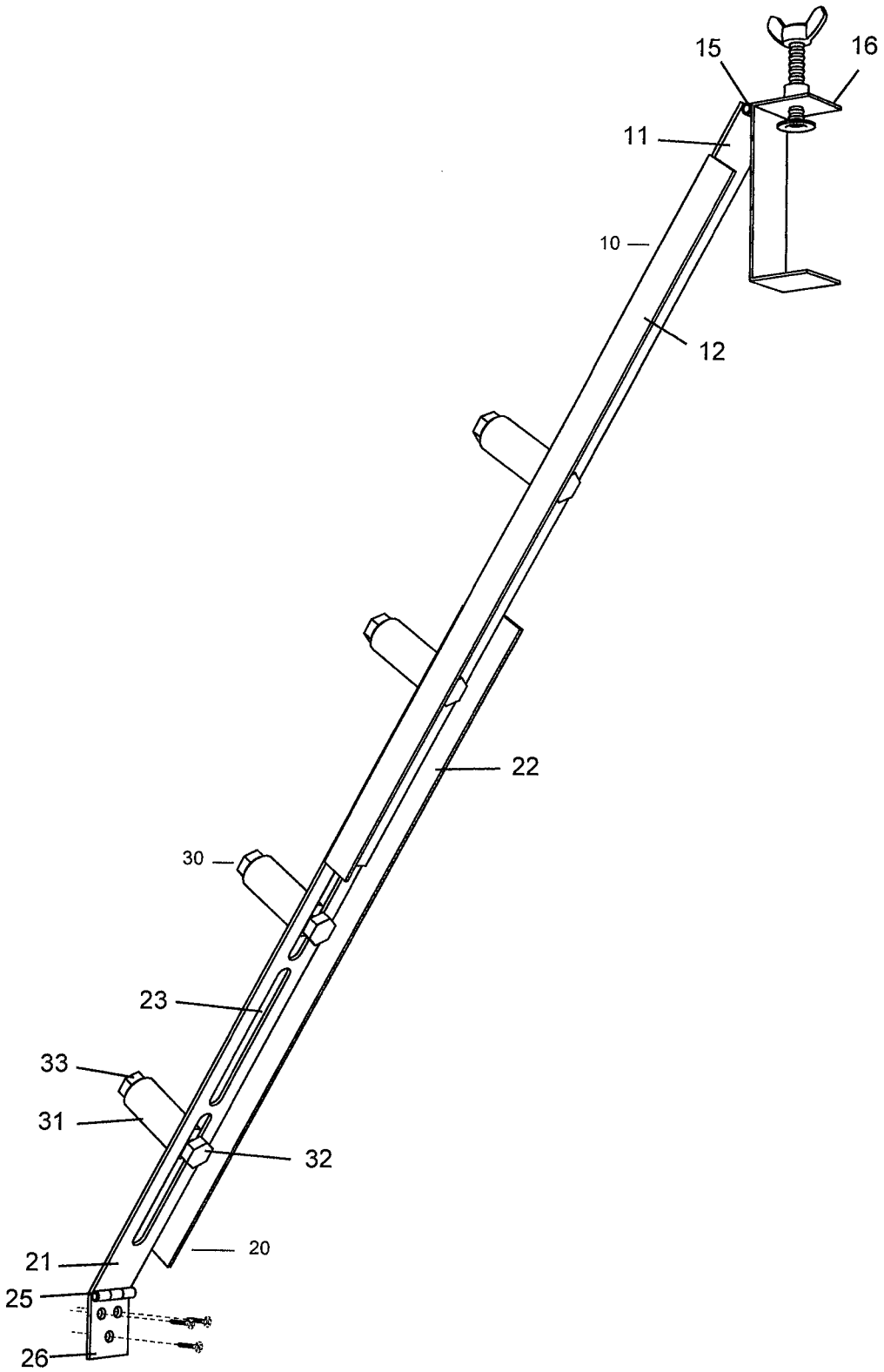
FIG. 2 depicts a close-up perspective view of the embodiment of FIG. 1, with the unclaimed environment removed.
Figure 3:
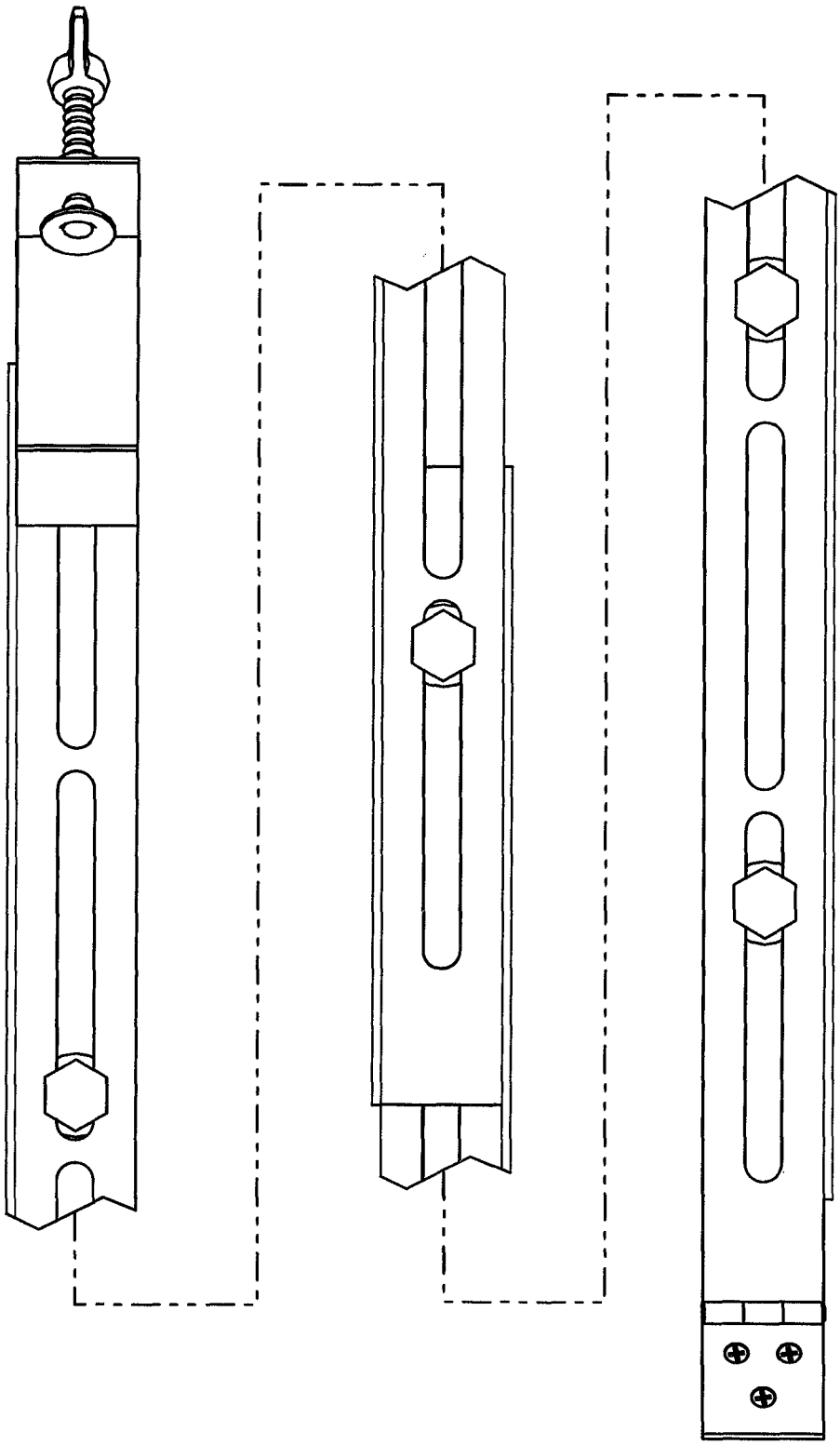
FIG. 3 depicts a bottom plan view thereof.
Figure 4:
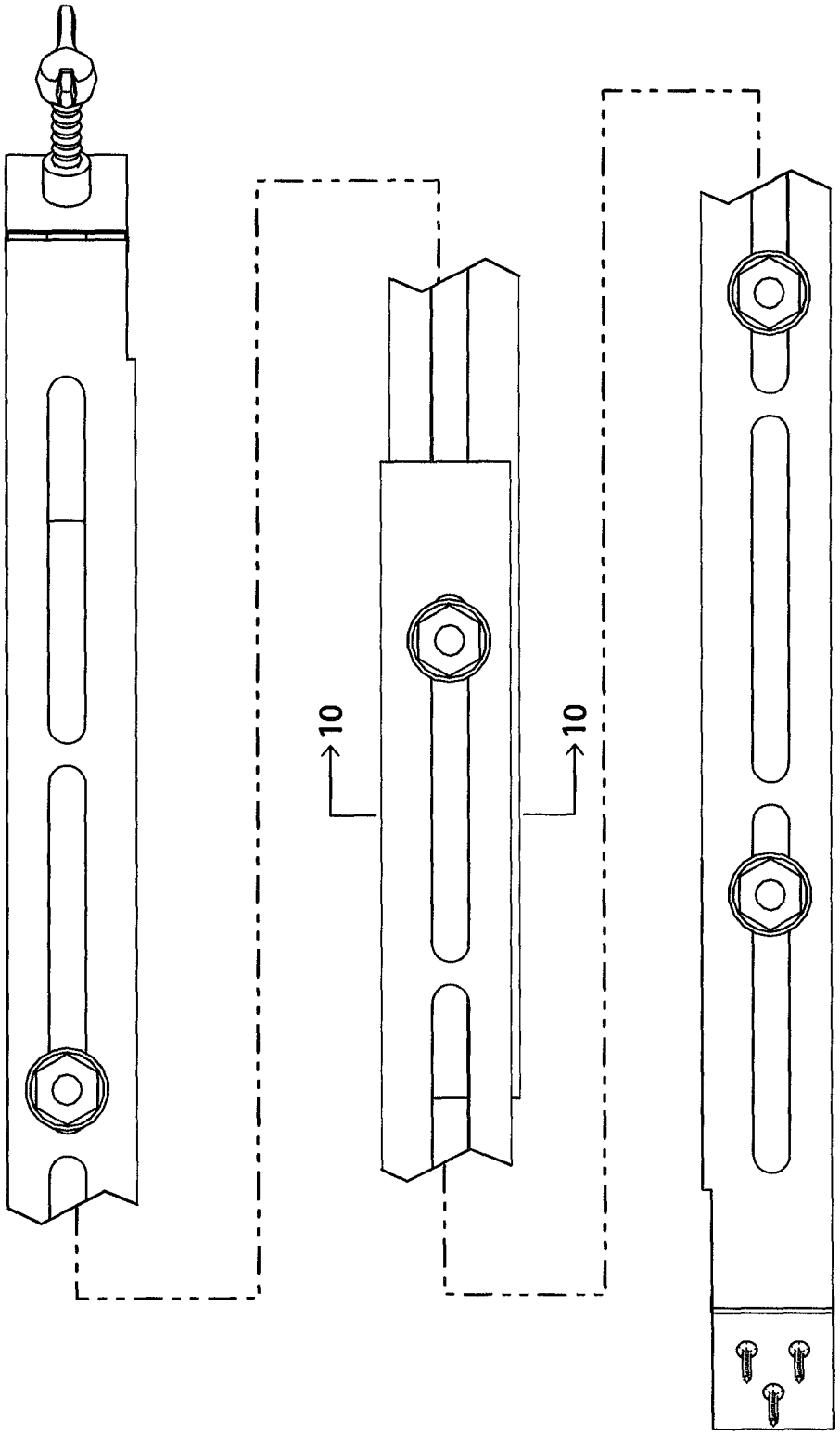
FIG. 4 depicts a top plan view thereof.
Figure 5:
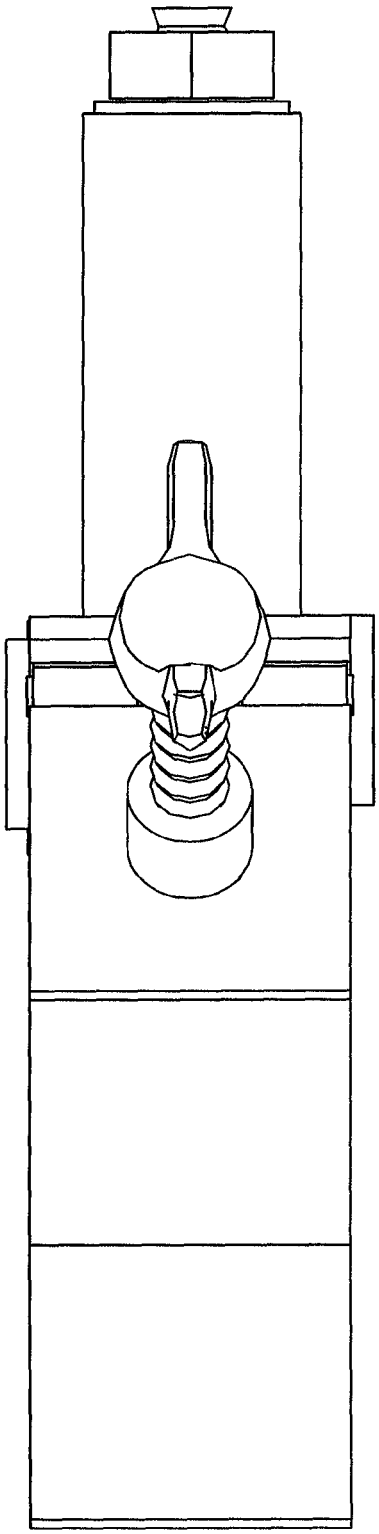
FIG. 5 depicts a rail-end elevation view thereof.
Figure 6:
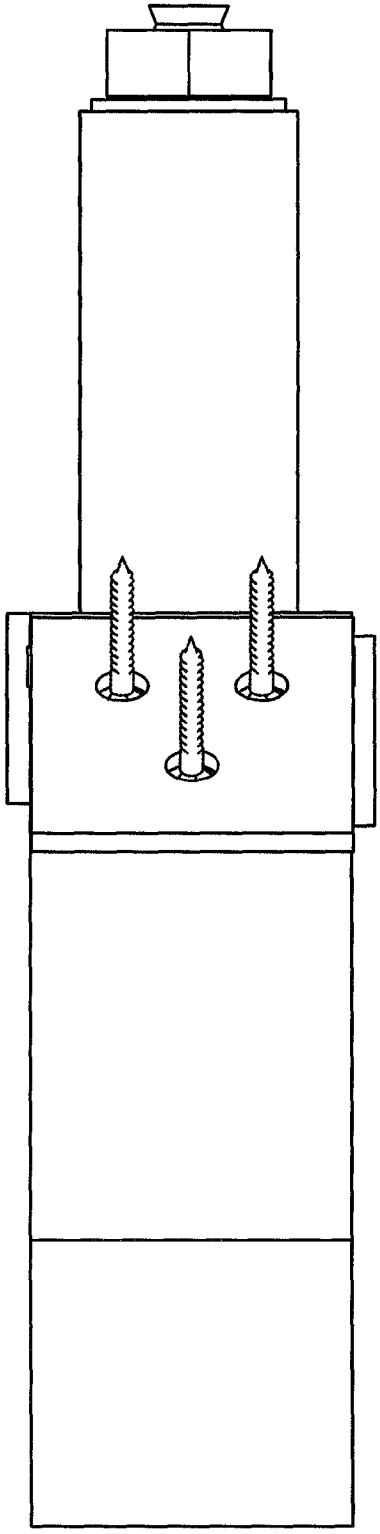
FIG. 6 depicts a wall-end elevation view thereof.

FIG. 2 depicts a pair of elongated L-tracks (10 and 20), each having a first elongate side (11 and 21) in slidable longitudinal alignment adjacent the first elongate side of the other L-track, each of the L-tracks having a second elongate side (12 and 22) separated from the second elongate side of the other L-track by at least the width of the first elongate sides in slidable longitudinal alignment, both L-tracks further may include a plurality of openings (13 and 23) in the first elongate sides, the openings of one of the L-tracks aligned with the at least one opening of the other of the L-tracks by the slidable engagement; FIG. 2 also depicts a plurality of stop members (30) for joining the elongated L-tracks at various combined lengths of the longitudinal alignment and for supporting an item to be supported by the rack, each stop member may include a spacer sleeve (31) defining a bore accepting an elongated fastener member (32) having a fastening end impaling the aligned L-track openings and having a nut (33) rotationally tightened thereon sufficient to prevent further sliding of the L-tracks. Also depicted is the second L-track including means of pivotal attachment to the vertical support element, including a lower end including a hinge-barrel adaptation (25) pivotally capturing a terminal wing member (26) for attachment to the vertical support element, the first L-track including means of pivotal attachment to the horizontal support element, including an upper end including a hinge-barrel adaptation (15) pivotally capturing a terminal wing member (16) for attachment to the horizontal support element, the terminal wing member further including a clamp for attachment to an appendage of the horizontal support.

Figure 7:
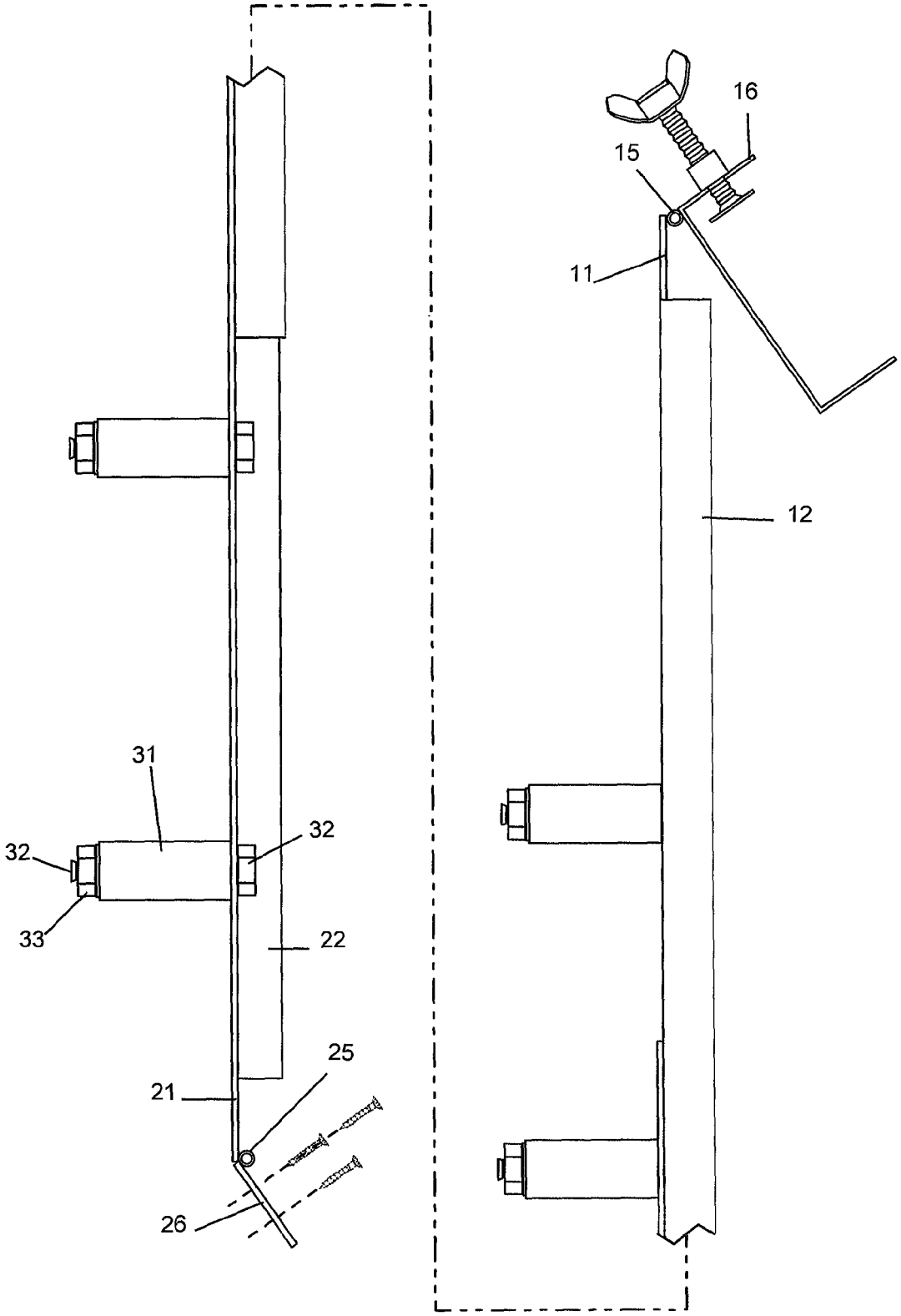
FIG. 7 depicts a first side elevation view thereof.
Figure 8:
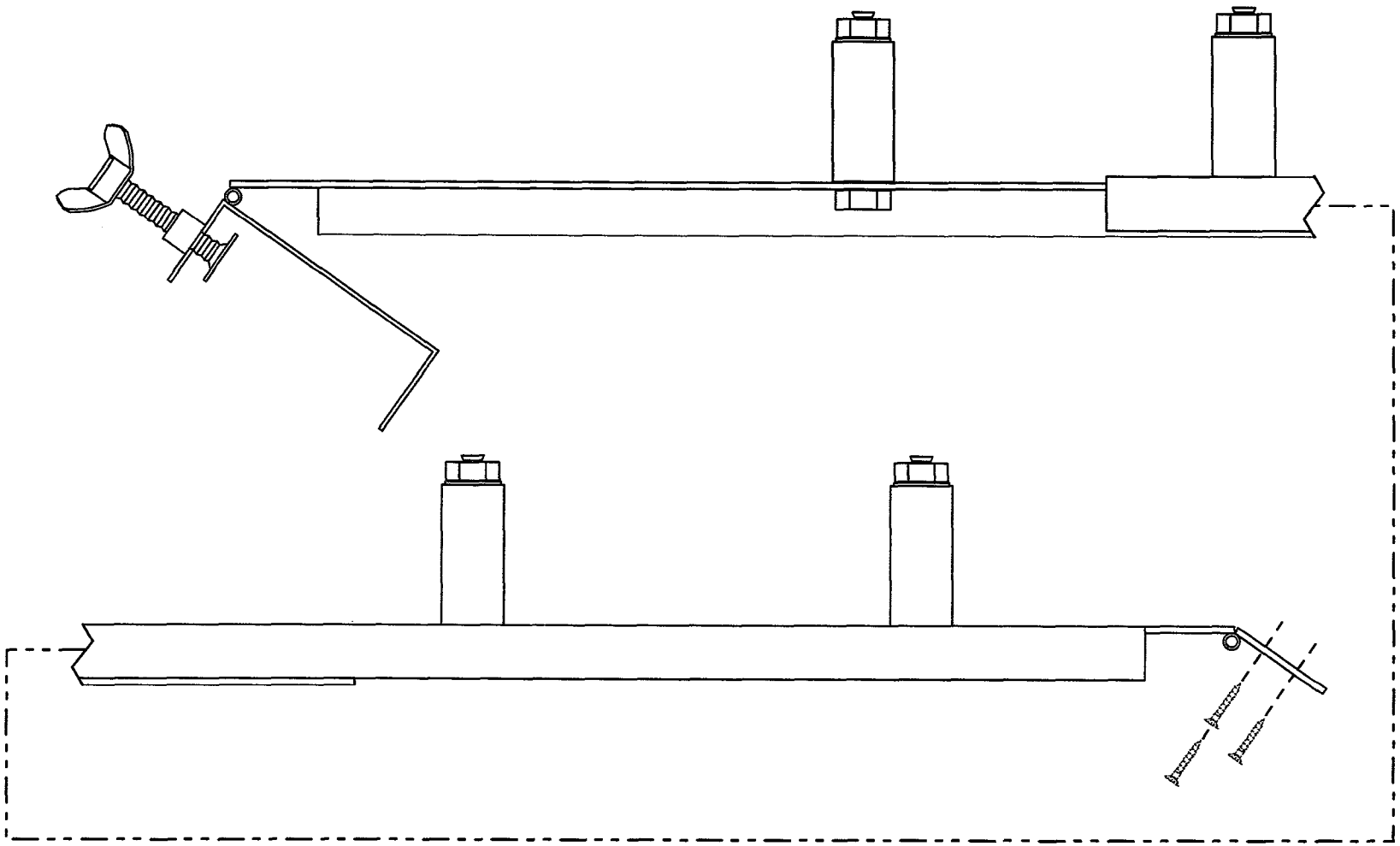
FIG. 8 depicts a second side elevation thereof.
Figure 9:
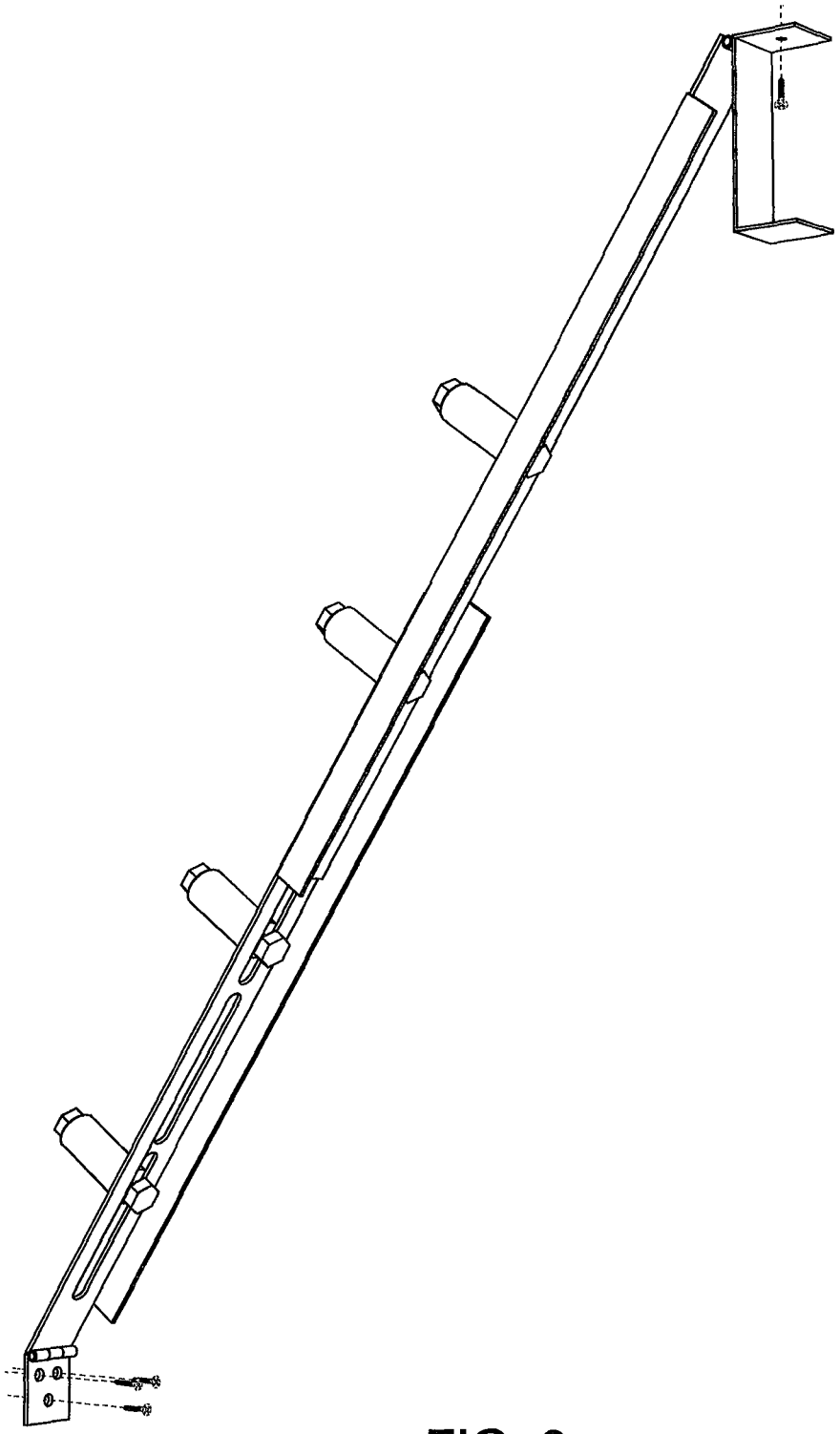
FIG. 9 depicts a close-up perspective view of an alternative embodiment.
Figure 10:
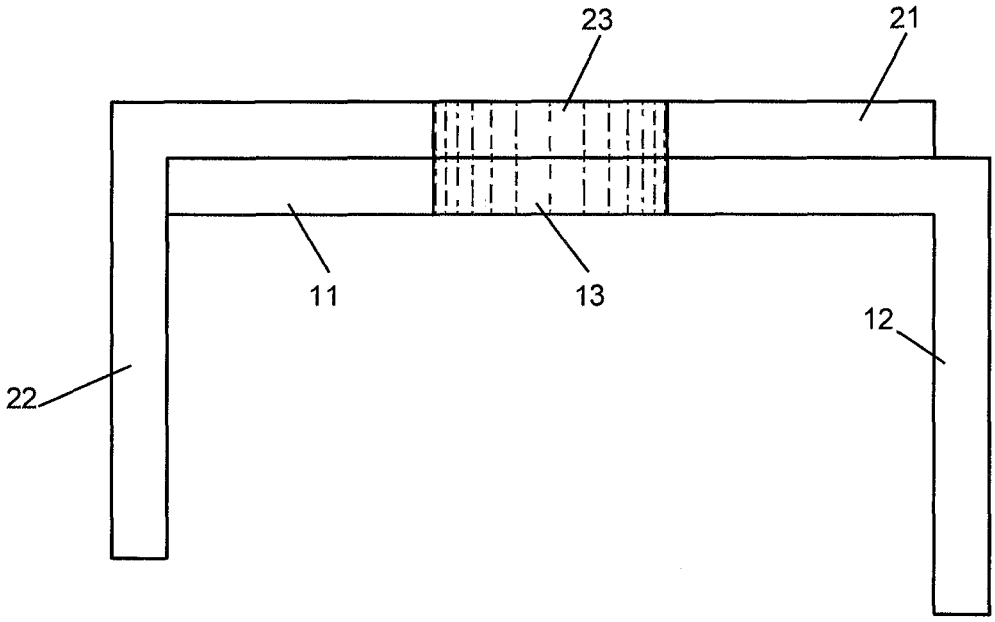
FIG. 10 depicts a transverse cross section of the embodiment of FIG. 1, at plane 10-10 of FIG. 4.

FIGS. 7 and 10 depict some of those enumerated features as well, in different views.

In general, the invention disclosed herein includes (comprises) a rack capable of attaching diagonally to both a vertical support (such as a wall) and to a horizontal support (such as a ceiling) or appendage thereof (such as a guide-track of an overhead-movable door). The rack may include a rigid rack member having a first end including a means of pivotal attachment to the horizontal support; also included is a second end including a means of pivotal attachment to the Vertical support. The rack further may include a plurality of support members for supporting at least one item to be supported by the rack. For example, the rack could include pegs, movably attached to the rack, or a U-shaped member movably attached to the rack (and with both uprights of the U sufficiently separated to allow balancing of an item).

The rack member may include a pair of elongate members in slidable longitudinal alignment. For example, slidable longitudinal alignment may be accomplished by a pair of elongate members in telescopic alignment. The members could be tubular, square or rectangular in cross section, of L-shaped in cross section.

The rack further may include a joinder means for joining the elongate members at various combined lengths of the longitudinal alignment. Any means of temporarily joining the elongate members in a desired length may be used, such as bolts with nuts.

In one particular embodiment, the elongate members may include a pair of elongated L-tracks, each having a pair of elongate sides intersecting at a longitudinal angulation corresponding to the longitudinal angulation of the other L-track; each L-track may include an elongate inner-angle surface and an elongate outer surface, each having a corresponding inner-angle surface and a corresponding outer surface, the inner-angle surface of the first L-track accepting the adjacent outer surface of the second L-track for slidable longitudinal engagement. Both L-tracks further may include a plurality of openings in one of the corresponding surfaces, the openings of one of the L-tracks aligned with at least one opening of the other of the L-tracks by the slidable engagement. The joinder means and the support members may be the same, such as a plurality of stop members; each stop member may essentially be a sleeved peg, including a first end portion traversing the aligned openings of the slidably engaged L-tracks and terminating in a fastener preventing further sliding of the L-tracks. Each stop member further may include a second end portion adapted to support an item to be supported by the rack.

In another particular embodiment, the elongate members may include a pair of elongated L-tracks, each having a first elongate side in slidable longitudinal alignment adjacent the first elongate side of the other L-track, each of the L-tracks having a second elongate side separated from the second elongate side of the other L-track by at least the width of the first elongate sides in slidable longitudinal alignment. Both L-tracks further may include a plurality of holes, slots or other openings in the first elongate side (preferably spaced periodically). The openings of one of the L-tracks will align with at least one opening of the other of the L-tracks by the slidable engagement; preferably, the multiple openings of both L-tracks will align at most points of slidable engagement.

The stop member may include a spacer sleeve defining a bore accepting an elongated fastener member having a fastening end impaling the aligned L-track openings and having a nut rotationally tightened thereon sufficient to prevent further sliding of the L-tracks and maintain a desired length of the L-tracks.

The first L-track may include the means of pivotal attachment to the horizontal support element (ceiling or rail of overhead-movable door). The means of pivotal attachment preferably includes an upper end having a hinge-barrel adaptation pivotally capturing a terminal wing member for attachment to the horizontal support element. This hinge-like connection facilitates attachment regardless of the diagonal angle of the rack extending from the horizontal support member to the vertical support member (such as a wall). The terminal wing member may have holes accepting an elongate fastener (such as a screw or nail) embedded into the ceiling as the horizontal support element.

The terminal wing member further may include a clamp for attaching to a guidetrack of an overhead-movable door. The clamp may include an opposing pair of parallel sides essentially perpendicular to and adjoining the wing member, one of the sides defining a threaded orifice through which an externally threaded fastener member (such as a bolt) is rotationally tightened until tightened against the guidetrack situated between the opposing pair of sides.

The second L-track of the rack member may include the means of pivotal attachment to the vertical support element (such as a wall). The means of pivotal attachment preferably includes a lower end including a hinge-barrel adaptation pivotally capturing a terminal wing member for attachment to the vertical support element. This hinge-like connection facilitates attachment regardless of the diagonal angle of the rack extending from the horizontal support member to the vertical support member (such as a wall). The terminal wing member may have holes accepting an elongate fastener (such as a screw or nail) embedded into the wall as the vertical support element.

Preferably, the racking mechanism will involve a second rack (of those described herein), attached to the horizontal support and vertical support in essentially parallel alignment with the first rack.

In one specific embodiment of a rack system capable of attaching diagonally to both a vertical support (such as a wall) and to a horizontal support (such as a ceiling) or appendage thereof (such as a guidetrack of an overhead-movable door), the rack system may include a plurality of racks, each including:

(a) a pair of elongated L-tracks (10 and 20), each having a first elongate side (11 and 21) in slidable longitudinal alignment adjacent the first elongate side of the other L-track, each of the L-tracks having a second elongate side (12 and 22) separated from the second elongate side of the other L-track by at least the width of the first elongate sides in slidable longitudinal alignment, both L-tracks further may include a plurality of openings (13 and 23) in the first elongate sides, the openings of one of the L-tracks aligned with the at least one opening of the other of the L-tracks by the slidable engagement;

(b) a plurality of stop members (30) for joining the elongated L-tracks at various combined lengths of the longitudinal alignment and for supporting an item to be supported by the rack, each stop member may include a spacer sleeve (31) defining a bore accepting an elongated fastener member (32) having a fastening end impaling the aligned L-track openings and having a nut (33) rotationally tightened thereon sufficient to prevent further sliding of the L-tracks;

(c) the second L-track including means of pivotal attachment to the vertical support element, including a lower end including a hinge-barrel adaptation (25) pivotally capturing a terminal wing member (26) for attachment to the vertical support element, the first L-track including including means of pivotal attachment to the horizontal support element, including an upper end including a hinge-barrel adaptation (15) pivotally capturing a terminal wing member (16) for attachment to the horizontal support element, the terminal wing member further including a clamp for attachment to an appendage of the horizontal support.

Besides the racks and rack systems described herein, the invention also includes a method of using the racks and rack systems. The steps for such method include, each rack: (a) slidably aligning both elongate rack members to a desired aggregate length with each's openings aligned to accept insertion and fastening of a plurality of stop members; and (b) pivotally attaching the respective end to the horizontal support and attaching the other respective end to the vertical support.

What is claimed is:

1. A rack capable of attaching diagonally to both a vertical support and to a horizontal support, said rack comprising:

(a) a rigid rack member having a first end comprising a means of pivotal attachment to the horizontal support and having a second end comprising a means of pivotal attachment to the vertical support, said rack member comprising a pair of elongate members in slidable longitudinal alignment comprising a pair of elongated L-tracks, each having a first elongate side in slidable longitudinal alignment adjacent the first elongate side of the other L-track, each of said L-tracks having a second elongate side separated from the second elongate side of the other L-track by at least the width of said first elongate sides, both L-tracks further comprising a plurality of openings in said first elongate sides, said openings of one of said L-tracks aligned with said at least one opening of the other of said L-tracks by said slidable engagement;

(b) a plurality of support members for supporting at least one item to be supported by said rack; and (c) a joinder means for joining said elongate members at various combined lengths of said longitudinal alignment, comprising said support members comprising a plurality of stop members, each comprising a first end portion traversing said aligned openings of said slidably engaged L-tracks and terminating in a fastener preventing further sliding of said L-tracks, each stop member further comprising a second end portion adapted to support an item to be supported by said rack.

2. A rack of claim 1, said stop member further comprising a spacer sleeve defining a bore accepting an elongated fastener member having a fastening end impaling said aligned L-track openings and having a nut rotationally tightened thereon sufficient to prevent further sliding of said L-tracks and maintain a desired length of said L-tracks.

3. A rack of claim 1, said first L-track including said means of pivotal attachment to the horizontal support element, comprising an upper end comprising a hinge-barrel adaptation pivotally capturing a terminal wing member for attachment to the horizontal support element.

4. A rack of claim 3, said terminal wing member defining holes accepting an elongate fastener embedded into the ceiling as the horizontal support element.

5. A rack of claim 4, said terminal wing member further comprising a clamp for attaching to a guidetrack of an overhead-movable door.

6. A rack of claim 5, said clamp comprising an opposing pair of parallel sides essentially perpendicular to and adjoining said wing member, one of said sides defining a threaded orifice through which an externally threaded fastener member is rotationally tightened until tightened against the guidetrack situated between said opposing pair of sides.

7. A rack of claim 1, said second L-track including said means of pivotal attachment to the vertical support element, comprising a lower end comprising a hinge-barrel adaptation pivotally capturing a terminal wing member for attachment to the vertical support element.

8. A rack of claim 7, said terminal wing member defining holes accepting an elongate fastener embedded into the wall as the vertical support element.

9. A rack of claim 1, further comprising a second rack attached to the horizontal support and vertical support in essentially parallel alignment with the first rack.

10. A rack of claim 3, further comprising a second rack attached to the horizontal support and vertical support in essentially parallel alignment with the first rack.

11. A rack of claim 4, further comprising a second rack attached to the horizontal support and vertical support in essentially parallel alignment with the first rack.

12. A rack of claim 5, further comprising a second rack attached to the horizontal support and vertical support in essentially parallel alignment with the first rack.

13. A rack of claim 6, further comprising a second rack attached to the horizontal support and vertical support in essentially parallel alignment with the first rack.

14. A rack of claim 7, further comprising a second rack attached to the horizontal support and vertical support in essentially parallel alignment with the first rack.

15. A rack system capable of attaching diagonally to both a vertical support and to a horizontal support, said rack system comprising a plurality of racks, each comprising:

(a) a pair of elongated L-tracks, each having a first elongate side in slidable longitudinal alignment adjacent the first elongate side of the other L-track, each of said L-tracks having a second elongate side separated from the second elongate side of the other L-track by at least the width of said first elongate sides in slidable longitudinal alignment, both L-tracks further comprising a plurality of openings in said first elongate sides, said openings of one of said L-tracks aligned with said at least one opening of the other of said L-tracks by said slidable engagement;

(b) a plurality of stop members for joining said elongated L-tracks at various combined lengths of said longitudinal alignment and for supporting an item to be supported by said rack, each stop member comprising a spacer sleeve defining a bore accepting an elongated fastener member having a fastening end impaling said aligned L-track openings and having a nut rotationally tightened thereon sufficient to prevent further sliding of said L-tracks;

(c) said second L-track including means of pivotal attachment to the vertical support element, comprising a lower end comprising a hinge-barrel adaptation pivotally capturing a terminal wing member for attachment to the vertical support element, said first L-track including means of pivotal attachment to the horizontal support element, comprising an upper end comprising a hinge-barrel adaptation pivotally capturing a terminal wing member for attachment to the horizontal support element, said terminal wing member further comprising a clamp for attachment to an appendage of the horizontal support.

* * * * *